US005207994A

United States Patent [19]

Suzuki et al.

[11] Patent Number: 5,207,994

[45] Date of Patent: May 4, 1993

[54] APPARATUS FOR INNOXIOUS DISPOSAL OF MEDICAL WASTES

[75] Inventors: Takashi Suzuki, Fukushima; Koichi Yamanobe, Sannohe, both of Japan

[73] Assignee: Sanyo Co., Ltd., Fukushima, Japan

[21] Appl. No.: 810,885

[22] Filed: Dec. 20, 1991

[30] Foreign Application Priority Data

Jan. 10, 1991 [JP] Japan ..... 3-65759

[51] Int. Cl.[5] ..... B01D 1/00; B30B 9/04

[52] U.S. Cl. ..... 422/307; 100/93 P; 100/232; 100/102; 110/223

[58] Field of Search ..... 422/307, 309; 100/93 P, 100/218, 232, 102, 246, 253, 240; 110/223

[56] References Cited

U.S. PATENT DOCUMENTS

| | | | |
|---|---|---|---|
| 3,456,581 | 7/1969 | Zuber | 100/93 P |
| 3,564,993 | 2/1971 | Tezuka | 100/218 |
| 3,908,538 | 9/1975 | Boyd | 100/232 |
| 3,955,492 | 5/1976 | Topolay | 100/218 |
| 4,334,466 | 6/1982 | Spiegelberg | 100/218 |
| 4,408,520 | 10/1983 | Wons et al. | 100/93 P |
| 4,706,560 | 11/1987 | Capodicasa | 100/102 |
| 5,044,271 | 9/1991 | Robbins et al. | 100/218 |

FOREIGN PATENT DOCUMENTS

| | | | |
|---|---|---|---|
| 2237430 | 12/1973 | France | 100/218 |

*Primary Examiner*—Robert J. Warden
*Assistant Examiner*—Laura E. Collins
*Attorney, Agent, or Firm*—Wenderoth, Lind & Ponack

[57] ABSTRACT

In construction of an apparatus for innoxious disposal of medical wastes, the medical wastes containing meltable components such as plastic resins, and unmeltable components such as syringe needles and residues are thrown into a compression hopper and compressed under application of heat by piston operation into a compact cake. Sharp unmeltable components such as syringe needles are totally embraced by the meltable components such that they are not exposed outside the obtained cake, thereby removing the danger in subsequent handling of the cake. Pathogenic germs in the residues are killed during application of heat and the residues are fully evaporated due to heating in an evaporation dish arranged below the compression hopper.

6 Claims, 3 Drawing Sheets

APPARATUS FOR INNOXIOUS DISPOSAL OF MEDICAL WASTES

BACKGROUND OF THE INVENTION

The present invention relates to an apparatus for innoxious disposal of medical wastes, and more particularly relates to improvement in innoxious disposal, i.e. disposal after making the waste harmless to the environment, of medical wastes such as syringe tubes, serum bottles, laboratory dishes and transfusion tubes mainly made of thermoplastic resins.

In general, for innoxious disposal of medical wastes, heat melting processes and crush sterilization processes have conventionally been employed.

The heat melting processes are further classified into two systems. In the first system, medical wastes are thrown into a heating bath arranged within an apparatus and are cooled into a solidified block after heat melting . In the second system, the solidified block is crushed into pieces. When disposed in block form, sharp articles such as syringe needles contained in the medical wastes tend to project from the block, which endanger subsequent handing of the block. In addition, plastic resins in the medical wastes maintain in bulky states during heat melting, thereby making handling difficult during the operation. When crushed, sharp articles such as syringe needles tend to remain in the crushed pieces without destruction, which again endangers subsequent handling of the pieces.

In the crush sterilization processes, medical wastes are first crushed in a crusher and next immersed into a sterilizer bath or subjected sterilizing spray in order to kill or paralyze pathogenic germs contained in the medical wastes. For reliable sterilization of residues in, for example, a syringe needle, complete mixing or replacement of the residue with a sterilizer is required. This is , however, very difficult in practice due to the small syringe needle spaces. In addition, these processes are also inevitably accompanied by the problem of residual sharp articles such as syringe needles.

SUMMARY OF THE INVENTION

It is an object of the present invention to provide an apparatus for innoxious disposal of medical wastes without the problems of residual sharp articles and bulky plastic components remaining in the medical wastes.

In accordance with the basic aspect of the present invention, a housing mounted on a pedestal is provided with a discharge port for a compact cake, an upright compression hopper arranged on the housing is provided with a charge port for medical wastes and a swingable closure for the charge port, a first piston unit mounted to the compression hopper is provided with a piston adapted for compressing the medical wastes downwards into the compact cake, a second piston unit mounted to the pedestal is provided with a movable closure adapted for closing and opening a bottom open end of the compression hopper, and an evaporation unit is arranged within the pedestal below the housing.

DESCRIPTION OF THE PREFERRED EMBODIMENTS

Figure 1:
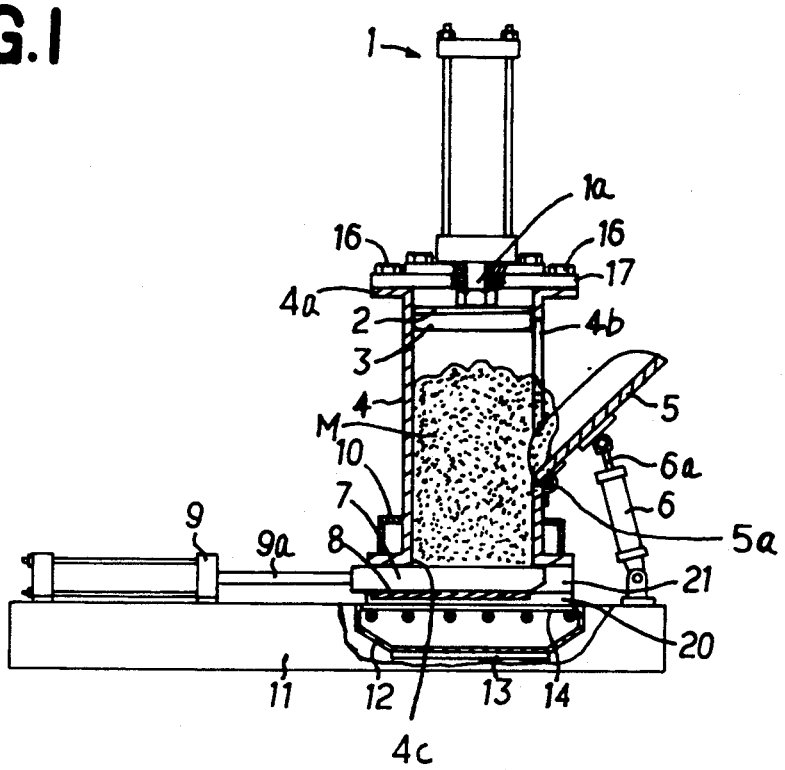
FIG. 1 is a partly sectional side view of one embodiment of the apparatus in accordance with the present invention in a state during receipt of medical wastes.

One embodiment of the apparatus in accordance with the present invention is shown in FIG. 1, in which a housing 20 is mounted on a flat pedestal 11 placed on a mill floor and provided with a discharge port 21 for discharging a compressed and compact cake m from the apparatus. A substantially upright compression hopper 4 is arranged on the housing 20 and provided on its side wall with a charge port 4*b*. Medical wastes M are thrown into the compression hopper through this charge port 4*b*. The charge port 4*b* is accompanied with a swingable closure 5 which is coupled to the side wall of the compression hopper 4 via a hinge 5*a*. A piston unit is arranged on the pedestal 11 and its hydraulic cylinder 6 is provided with a piston rod 6*a* operably coupled to the closure 5 for the charge port 4*b*.

An outer flange 4*a* is formed at the top end of the compression hopper 4 to which a lid 17 is secured by means of set bolts 16. A piston unit having a hydraulic cylinder 1 is arranged on the lid with its piston rod 1*a* slidably extending through the center hole formed in the lid 17. Inside the compression hopper 4, the piston rod 1*a* is provided at its lower end with a piston 3 adapted for compressing the medical wastes M received in the compression hopper 4. The piston 3 is accompanied on its upper face with a heater 2 such as an electric heater.

Another piston unit having a hydraulic cylinder 9 is arranged on the pedestal 20. A piston rod 9*a* of the hydraulic cylinder 9 is coupled to a closure 7 which is movable within the housing 20 so as to close or open the bottom open end 4*c* of the compression hopper 4. The closure 7 is provided on its lower face with a heater 8 such as an electric heater. At a level just above the housing 20, the compression hopper 4 is surrounded with a cooling jacket 10 connected to a proper cooling source (not shown).

An evaporation unit is arranged within the pedestal below the housing 20. More specifically, the evaporation unit includes a filter grid 14 arranged beneath the housing 20 and an evaporation dish 12 arranged below the filter grid 14. A heater 13 such as an electric heater is arranged on the bottom of the evaporation dish 12.

The apparatus operates as follows. The operation roughly includes three major processes, i.e. supplementary compression of medical wastes, primary compression of the medical wastes and discharge of a compressed and compact cake.

Figure 2:
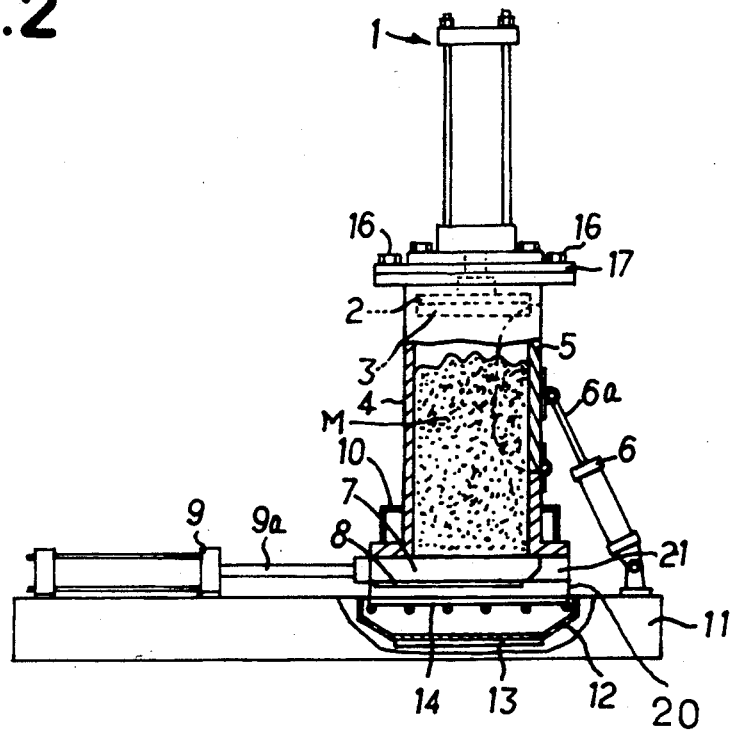
FIG. 2 is a partly sectional side view of the apparatus with the medical wastes enclosed.

In the supplementary compression processes, medical wastes M are thrown into the compression hopper 4 via the charge port 4*b* opened as shown in FIG. 1. when the interior of the compression hopper is almost full of the medical wastes M, the hydraulic cylinder 6 is activated so as to advance its piston rod 6*a* and close the charge port 4*b* with the closure 5 as shown in FIG. 2 while applying supplementary compression to the bulky medical wastes M within the compression hopper 4.

Figure 3:
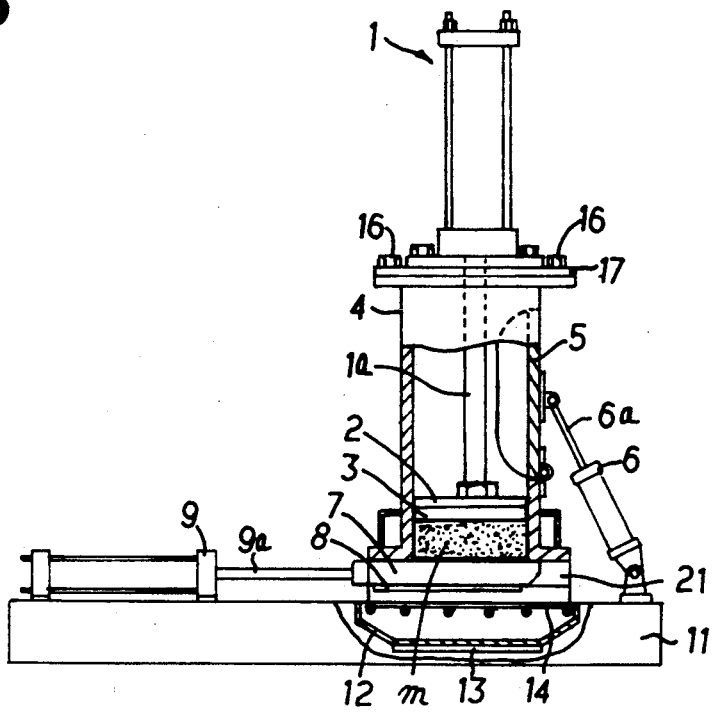
FIG. 3 is a partly sectional side view of the apparatus with the medical wastes in a compressed state.

In the primary compression, the hydraulic cylinder 1 is activated so as to advance its piston rod 1*a* and move the piston 3 downwards so as to compress the medical wastes M as shown in FIG. 3. Concurrently with this primary compression, the heaters 2 and 8 are energized to heat the medical wastes M under pressure. Thanks to this heating, meltable components in the medical wastes M are molten and sterilization of pathogenic germs in the medical wastes M is carried out. Preferably, the heaters 2 and 8 are energized prior to the primary compression for preliminary heating of the compression hopper 4. Such preliminary heating accelerates melting of the meltable components and heating of the medical wastes M.

Residues contained in the medical wastes M are squeezed out under pressure during the compression and fall into the evaporation dish 12 through the open bottom end 4*c* of the compression hopper 4 and are evaporated due to heating by the heater 13 attached to the evaporation dish 12. Concurrently with this evaporation, pathogenic germs in the residues are sterilized by the heating.

As long as the percent by weight of unmeltable components such as syringe needles is in a range up to 30%, most residues in the medical wastes M are squeezed out by heating at a temperature above the highest melting point of the meltable components in the medical wastes M, more preferably at a temperature high enough to kill pathogenic germs in the residues. As a result, a very compact cake m is obtained. Additional cooling by the cooling jacket 10 further promotes compactness of the resultant cake m.

As long as the percent by weight of the unmeltable components such as syringe needles is in the above-specified range, the meltable components such as plastic resins will melt and totally embrace the unmeltable components after solidification. As a consequence, no sharp articles project outside the resultant cake m.

As a result of the evaporation of the residues, only a very small amount of solid substances remain in the evaporation dish 12. Due to heating by the heater 13, such remaining solid substances are quite harmless and can be handled just like the cake m.

Figure 4:
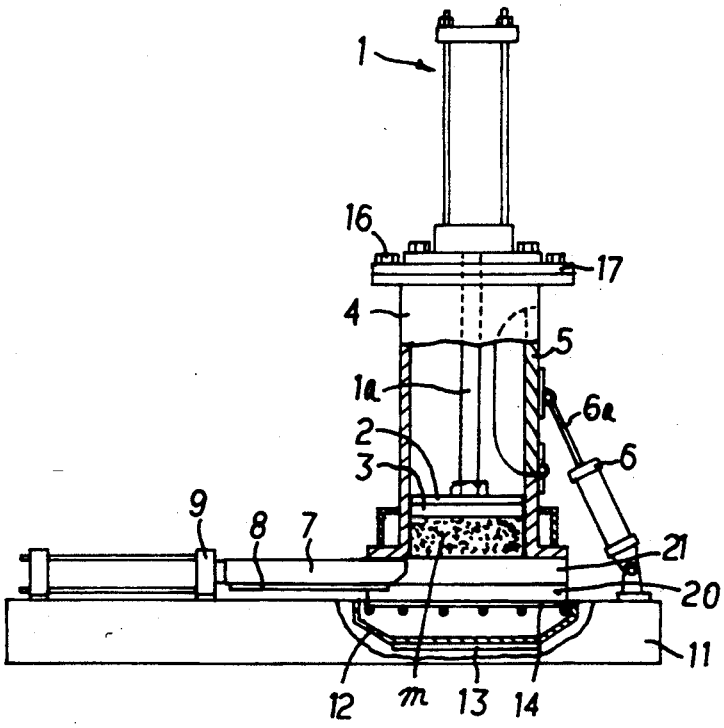
FIG. 4 is a partly sectional side view of the apparatus in a state in which it is ready to drop a compact cake onto an evaporation unit.
Figure 5:
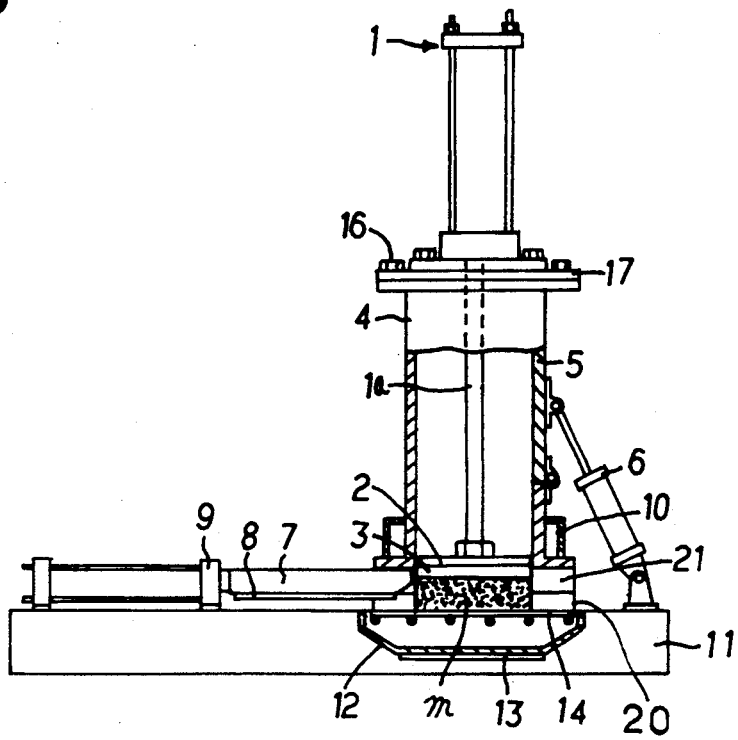
FIG. 5 is a sectional side view of the apparatus in a state for causing evaporation.
Figure 6:
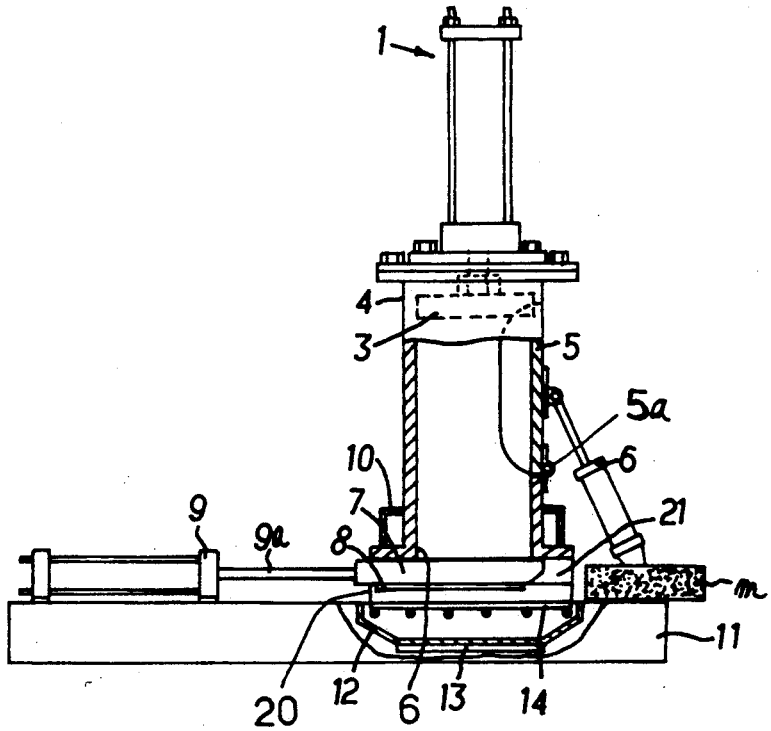
FIG. 6 is a partly sectional side view of the apparatus in a state for discharging the compact cake.

Finally, the hydraulic cylinder 9 is activated to retract its piston rod 9*a* so that the closure 7 opens the bottom end 4*c* of the compression hopper 4 as shown in FIG. 4. Next, the hydraulic cylinder 1 is again activated so as to further advance its piston rod 1*a* with the piston 3 and the cake is forced out into the housing 20 as shown in FIG. 5. By further activation of the hydraulic cylinder 9, the closure 7 advances to push the cake m out of the apparatus via the discharge port 21. Thereafter, the closure 7 again closes the bottom open end of the compression hopper 4, the piston 3 returns to its initial upper position and the closure 5 opens the charge port 4*b* for again receiving new medical wastes M.

EXAMPLES

Using the arrangement shown in FIG. 1, medical wastes contaminated with dead grass germs (16 hours) are thrown into the compression hopper 4 for compression with heat. Germs contained in the resultant cake m were extracted and subjected to 24 hour culture. The results are shown in the following table.

| | | |
|---|---|---|
| Sample 1 | heating temperature: | 160° C. |
| | pressure: | 20 t |
| | heating time: | 50 min |
| | sampling location: | cake surface |
| | result of culture: | negative |
| Sample 2 | heating temperature: | 160° C. |
| | pressure: | 20 t |
| | heating time: | 40 min |
| | sampling location: | cake surface |
| | result of culture: | negative |
| Sample 3 | heating temperature: | 160° C. |
| | pressure: | 20 t |
| | heating time: | 30 min |
| | sampling location' | cake surface |
| Sample 4 | heating temperature: | 160° C. |
| | pressure: | 20 t |
| | heating time: | 20 min |
| | sampling location: | cake surface |
| | result of culture: | negative |
| Sample 5 | heating temperature: | 160° C. |
| | pressure: | 20 t |
| | heating time: | 50 min |
| | sampling location: | cake surface |
| | result of culture: | negative |

It is clear from the data thus obtained, that almost perfect sterilization can be carried out using the apparatus in accordance with the present invention.

We claim:

1. An apparatus for innoxious disposal of medical wastes, comprising:

a pedestal;

A housing mounted on said pedestal and provided with a discharge port;

an upright compression hopper arranged on said housing and provided with a charge port for charging medical wastes into said hopper, and an open bottom end;

a swingable first closure for selectively opening and closing said charge port;

a movable second closure for selectively opening and closing said open bottom end of said hopper;

a first piston unit mounted atop said hopper and including a piston for compressing the medical wastes charged into said hopper downwardly toward said open bottom end of said hopper to form a compact cake;

a second piston unit mounted to said pedestal and operably connected with said movable second closure for moving said movable second closure between open and closed positions;

a cooling jacket surrounding a lower section of said hopper;

a first heater attached to said first piston unit;

a second heater attached to said movable second closure; and an evaporation unit arranged within said pedestal below said housing, said evaporation unit including a filter grid arranged beneath said housing, and evaporation dish arranged below said filter grid, and third heater attached to said evaporation dish.

2. An apparatus as recited in claim 1, further comprising a third piston unit arranged on said pedestal and operably coupled with said swingable first closure to move said swingable first closure between open and closed positions relative to said charge port.

3. An apparatus for innoxious disposal of medical wastes, comprising:

a base having a discharge port;

an upright compression hopper arranged on said base and provided with a charge port for charging medical wastes into said hopper, and an open bottom end;

a swingable first closure for selectively opening and closing said charge port;

a second closure slidably mounted in said base for movement between a closed position in which it closes said open bottom end of said hopper and said discharge port of said base, and an open position in which it is retracted from said open bottom end of said hopper;

a first piston means for compressing the medical wastes charged into said hopper downwardly against said second closure to form a compact cake;

a second piston means for sliding said second closure from said closed position after the compact cake has been formed thereon to said open position to allow the compact cake to be pressed downwardly out of said open bottom end of said hopper such that the compact cake is disposed between said second closure and said discharge port, and for sliding said second closure from said open position with a compact cake disposed between said second closure and said discharge port to said closed position to discharge the compact cake through said discharge port; and an evaporation unit disposed in said base beneath said open bottom end of said hopper, said evaporation unit including an evaporation dish for receiving liquid pressed from medical wastes during compression thereof, a filter grid mounted above said evaporation dish for supporting the compact cake and allowing the liquid from the medical wastes to flow into said evaporation dish, and an evaporation heater mounted adjacent said evaporation dish for heating said evaporation dish and evaporating and sterilizing the liquid from the medical wastes.

4. An apparatus as recited in claim 3, wherein said first piston means comprises a first piston;

said second piston means comprises a second piston;

a first heater is mounted to said first piston; and a second heater is mounted to said second closure.

5. An apparatus as recited in claim 4, further comprising a cooling jacket surrounding a lower section of said hopper.

6. An apparatus as recited in claim 3, further comprising a third piston means for moving said swingable first closure between open and closed positions relative to said charge port.

* * * * *